US008127401B2

(12) United States Patent
Folk et al.

(10) Patent No.: US 8,127,401 B2
(45) Date of Patent: Mar. 6, 2012

(54) METHOD AND REMOVABLE CLIP FOR HOLDING A VEHICLE DOOR OPEN

(75) Inventors: Patrick L. Folk, St. Clair Shores, MI (US); Craig Angelo Moccio, Milan, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 209 days.

(21) Appl. No.: 12/575,502

(22) Filed: Oct. 8, 2009

(65) Prior Publication Data

US 2011/0083301 A1 Apr. 14, 2011

(51) Int. Cl.
*E05D 11/06* (2006.01)

(52) U.S. Cl. ..... 16/374; 16/377

(58) Field of Classification Search ..... 16/374, 16/375, 82, 86 B, 377; 296/146.11, 146.12; 292/339, 342, 343

See application file for complete search history.

(56) References Cited

U.S. PATENT DOCUMENTS

| | | | | |
|---|---|---|---|---|
| 2,201,594 | A * | 5/1940 | Sitts | 292/76 |
| 2,259,821 | A * | 10/1941 | Johnson | 16/375 |
| 6,016,588 | A * | 1/2000 | Kamerschen | 16/82 |
| 6,334,236 | B1 | 1/2002 | Kalliomaki | |
| 6,360,407 | B1 | 3/2002 | Webster et al. | |
| 6,892,425 | B2 | 5/2005 | Smith | |
| 6,948,214 | B2 | 9/2005 | Spalding et al. | |
| 7,076,836 | B1 | 7/2006 | Butka | |
| 2003/0140455 | A1 * | 7/2003 | Audisio | 16/334 |
| 2007/0094844 | A1 * | 5/2007 | Nelson | 16/337 |
| 2009/0307874 | A1 * | 12/2009 | Anillo Crespo et al. | 16/380 |

FOREIGN PATENT DOCUMENTS

| | | | |
|---|---|---|---|
| FR | 2871833 | A1 * | 12/2005 |
| WO | WO 9714861 | A1 * | 4/1997 |

* cited by examiner

*Primary Examiner* — Chuck Y. Mah
(74) *Attorney, Agent, or Firm* — Gregory P. Brown; Brooks Kushman P.C.

(57) ABSTRACT

A clip is attached to the hinge of a vehicle door to hold the door open during electro-coating and painting. The hinge is assembled with the clip to the vehicle prior to painting. The hinge is taken apart after painting to separate the door from the vehicle. An end of the clip may include at least one ramp surface and a pair of walls that define a receiver in which a stop attached to the door is received. The stop is captured in the receiver of the clip to hold the door open.

7 Claims, 5 Drawing Sheets

METHOD AND REMOVABLE CLIP FOR HOLDING A VEHICLE DOOR OPEN

BACKGROUND

1. Technical Field

The present invention relates to a clip that is used to hold a door open during electro-coating and painting of a vehicle.

2. Background Art

Vehicles are generally produced on assembly lines where component parts are assembled together. Painted frame body components including body panels, doors and structural components are assembled and then electro-coated and painted as a unit to assure acceptable paint quality. After painting, the doors are disassembled from the vehicle to provide access for the assembly of internal components to the doors, such as windows, window operating mechanisms, door handles, lock mechanisms, interior soft trim panels, and the like. The doors are reassembled to the vehicle at a later point on the assembly line.

The doors of a vehicle must be held open during electro-coating and painting to assure complete coverage and to avoid damage to the surface coatings. Door checks that are incorporated in the vehicle are not installed prior to the electro-coating and painting because they are not painted with the vehicle to assure proper operation and avoid paint quality problems. Temporary clips or other tools have been proposed, but may be unacceptable due to various reasons such as the effectiveness of the tools, cost, or because they unduly complicate the vehicle manufacturing process.

The present invention is directed to providing an improved method of holding a vehicle door open and to an improved removable clip that is effective and may be provided at a relatively low cost. Further, installation and removal of the clip do not substantially complicate the vehicle manufacturing process and do not require additional process steps or added labor costs.

The above problems and others are addressed by Applicants' invention as summarized below.

SUMMARY

According to one aspect of this development, a clip is assembled to the hinge pin of a vehicle door that is used to hold the door in the full open position and prevent closure of the door during electro-coating and painting.

The clip is bolted onto the hinge pin or hinge fastener when the hinge is first assembled as a subassembly prior to assembly to the vehicle door. The hinge is assembled to the vehicle prior to painting. The hinge is taken apart to separate the door from the vehicle after electro-coating and painting. The clip may be simply disposed of after the clip is removed from the hinge.

The end of the clip opposite the hinge fastener may include a ramp surface and a receiver area that receives a stop provided on a door plate of the hinge. The door is swung open on the assembly line with the stop moving up the ramp until the stop is received in the receiver portion of the clip. The clip flexes axially as the stop moves across the ramp and then returns when the stop is received in the receiver. The stop is captured in the receiver of the clip to hold the door open during electro-coating and painting. A substantial force of approximately 10 Newtons is required to release the stop from the receiver.

The receiver may be formed on the clip as a channel having two spaced walls that engage opposite sides of the stop. While at least one side of the receiver may have a ramp surface, it is also possible to provide a ramp surface on opposite sides of the clip to permit a clip to be designed that may be interchangeably used on the right hand or left hand side of a vehicle.

A peripheral lip may be provided at least partially about the periphery of the clip. Further, the clip may define at least one gap in the peripheral lip through which fluid may drain from the clip that is deposited within the clip when the hinge is dipped in an electro-coating bath.

The clip may have an arm that extends radially outwardly from the opening defined in the clip that receives the pivot pin. A stiffening rib may be formed on the arm to extend radially outwardly from the opening that receives the pivot pin. The arm may define a drain hole through which fluid is drained from the stiffening rib that is deposited in the stiffening rib when the hinge is dipped in the electro-coating bath.

The clip may be provided with a ramp surface that causes the clip to shift axially in a first direction as the door is opened and that has a first axially extending wall adjacent the ramp surface. The stop is captured between the first axially extending wall and a second axially extending wall when the stop is disposed in the receiver to resist door closure. The second wall may extend to a greater axial extent than the first wall to locate the clip relative to the pillar plate.

A method of holding a door of a vehicle open during manufacturing operation is also provided by Applicants. The method may include preassembling a clip to a hinge with the clip being received on a hinge pin of the hinge. The hinge and clip are assembled to the door and to the vehicle. The door is then opened to a point where the clip holds the door in an open position. The vehicle is then electro-coated and painted with the doors assembled to the vehicle. The hinge pin is then disassembled from the vehicle and the clip is disassembled from the hinge pin. The door may then be separated from the vehicle to perform additional manufacturing operations on the door. The door is then reassembled to the vehicle and attached to the vehicle.

These and other aspects of the present invention will be better understood in view of the attached drawings and the following detailed description of the illustrated embodiments.

DETAILED DESCRIPTION

Figure 1:
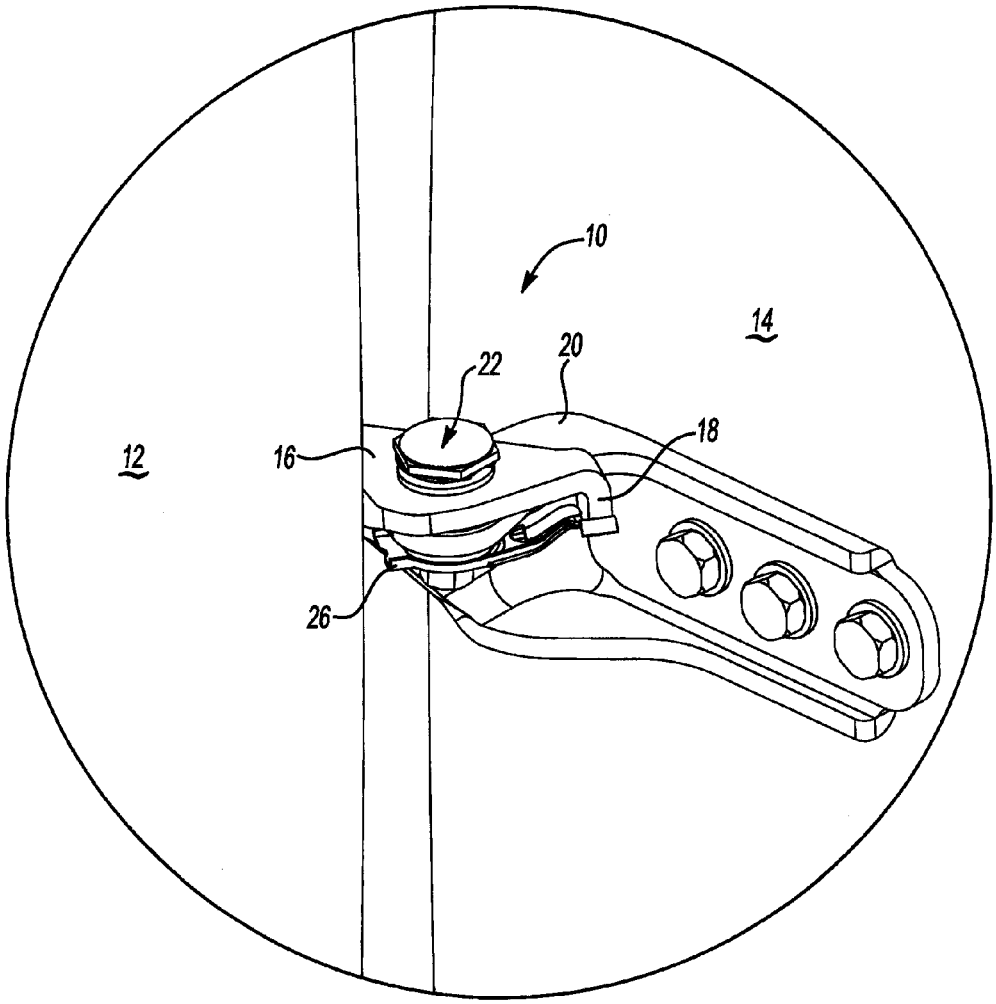
FIG. 1 is a perspective view of a hinge for a door of a vehicle with the clip of the present invention shown holding a door in its open position.

Referring to FIG. 1, a hinge 10 is shown connected to a door 12 of a vehicle 14. A door plate 16 includes a stop 18. A hinge pillar plate 20 is shown attached to the vehicle 14 with a pivot pin assembly 22 shown securing the door plate 16 to the pillar plate 20. A hold open clip 26 is assembled to the pivot pin assembly 22. As shown in FIG. 1, the door 12 is held in the open position with the stop 18 retained by the clip 26.

Figure 2:
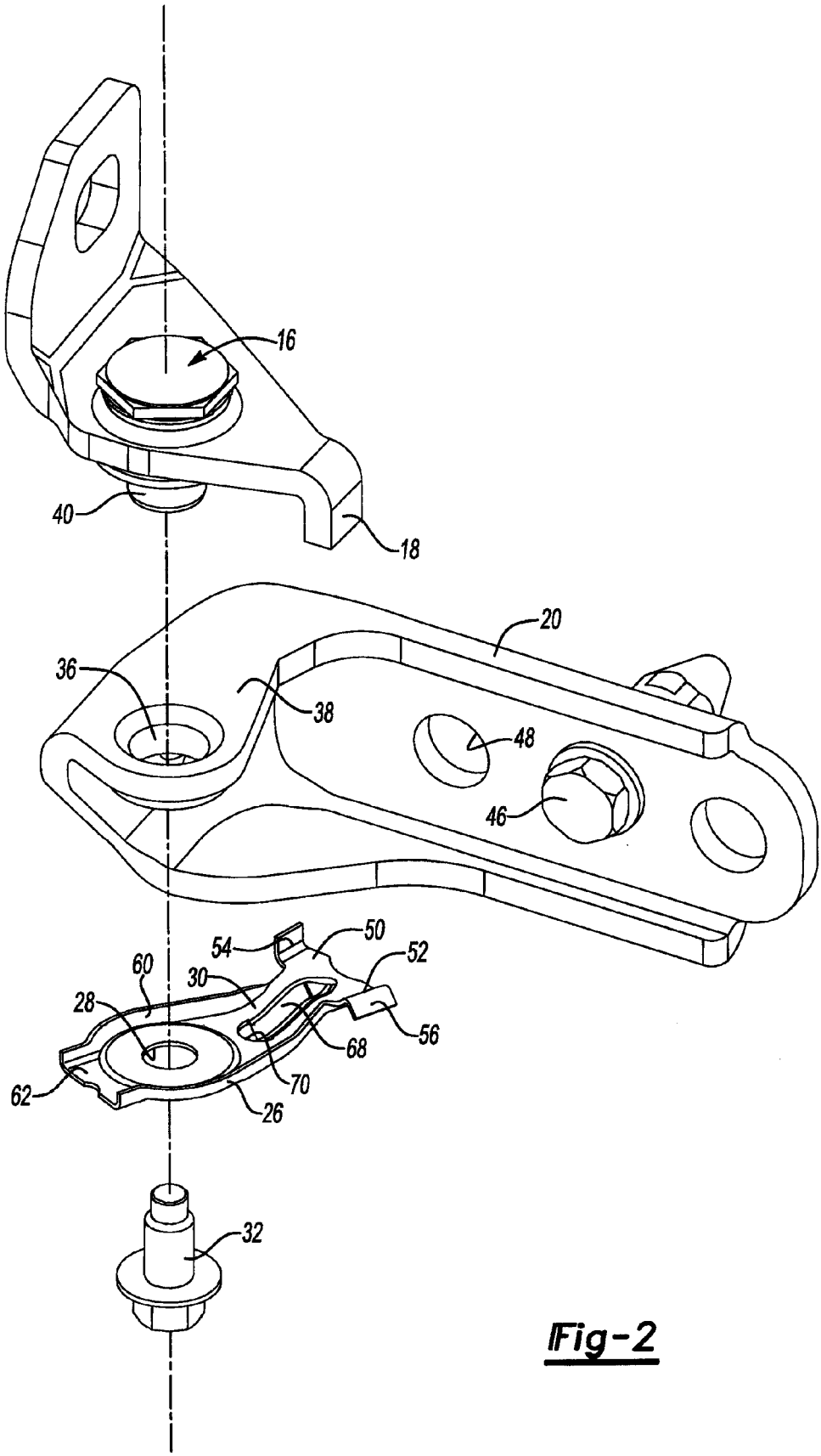
FIG. 2 is an exploded perspective view of the hinge and clip of the present invention.
Figure 3:
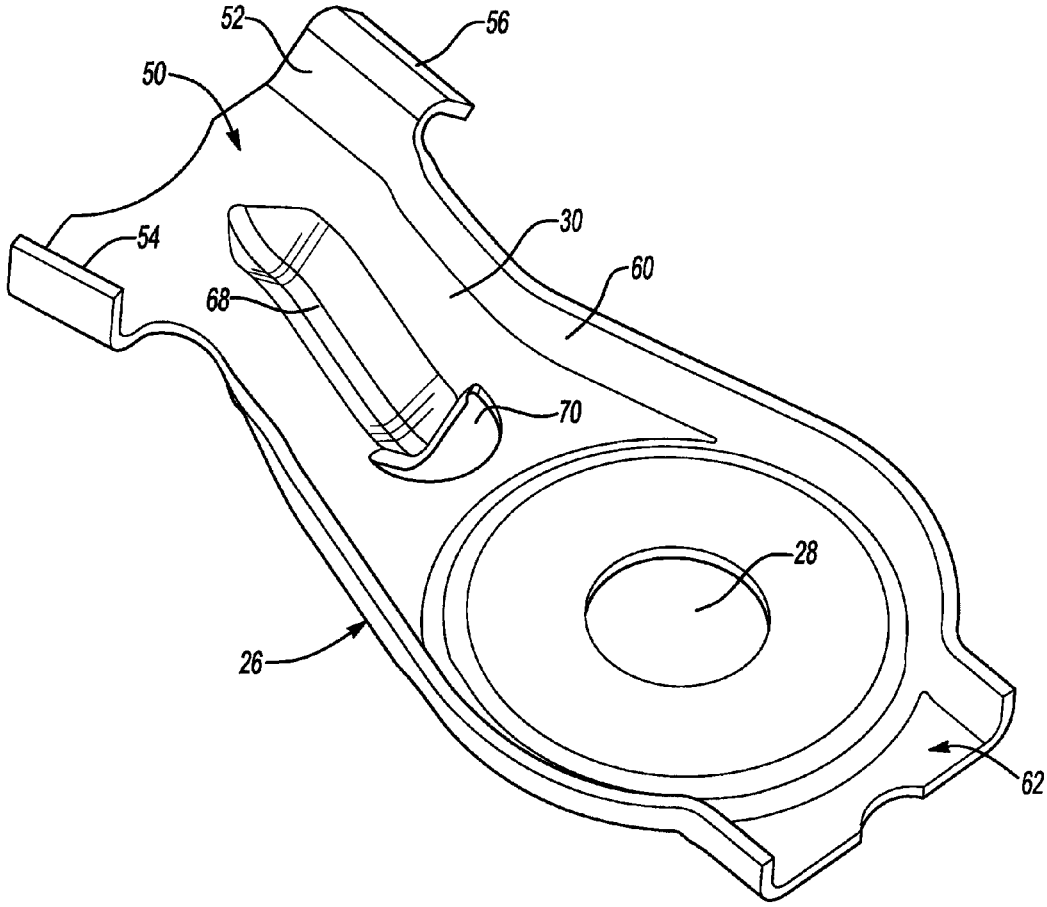
FIG. 3 is a perspective view of the clip.

Referring to FIGS. 2 and 3, the door plate 16, pillar plate 20, pivot pin assembly 22, and clip 26 are shown in greater detail. The clip 26 includes an opening 28 in which the pivot pin assembly 22 is received. The clip 26 includes an arm 30 that extends radially outwardly relative to the opening 28.

The pivot pin assembly 22 is a multi-part assembly including a lower pin 32 that is inserted through opening 28 in the clip 26. The lower pin 32 extends through an opening 36 in a flange 38 of the pillar plate 20.

An upper hinge pin 40 receives the lower pin 32. The upper hinge pin 40 is secured to the door plate 16 and connects door plate 16 to pillar plate 20. The lower pin 32, or fastener, is secured to the upper hinge pin 40 to assemble the hinge 10 together and may be removed to permit the door plate and upper hinge pin 40 to be removed with the door for subsequent door assembly operations. A fastener 46 is shown inserted through a hole 48 formed in pillar plate 20. The fastener 46 secures the pillar plate 20 to the vehicle.

Referring to FIG. 3, the clip 26 is shown to include the opening 28 that receives the lower pin 32 as previously described. The arm 30 of the clip 26 extends radially outwardly from the hole 28. A receiver 50, or recessed area, is located between a first wall 52 and a second wall 54. The stop 18 (not shown in FIG. 3) is received in the receiver 50 between the first and second walls 52, 54 to hold the door in an open position during electro-coating and painting. A ramp surface 56 may be provided adjacent to the first wall 52 to facilitate moving the door to its open position by facilitating entry of the stop 18 into the receiver 50.

The clip 26 has a lip 60 extending on both sides of the arm 30. The lip 60 functions to make the clip 26 more rigid along the length of the arm 30. A gap 62 is provided in the lip 60. Excess electro-coating solutions may drain from the clip 26 through the gap 62. A stiffening rib 68 may be provided that extends along a portion of the length of the arm 30. The stiffening rib 68 also functions to stiffen the arm 30. A drain hole 70 is provided at one end of the stiffening rib 68 to permit excess electro-coating solutions to drain from the clip 26.

Figure 4:
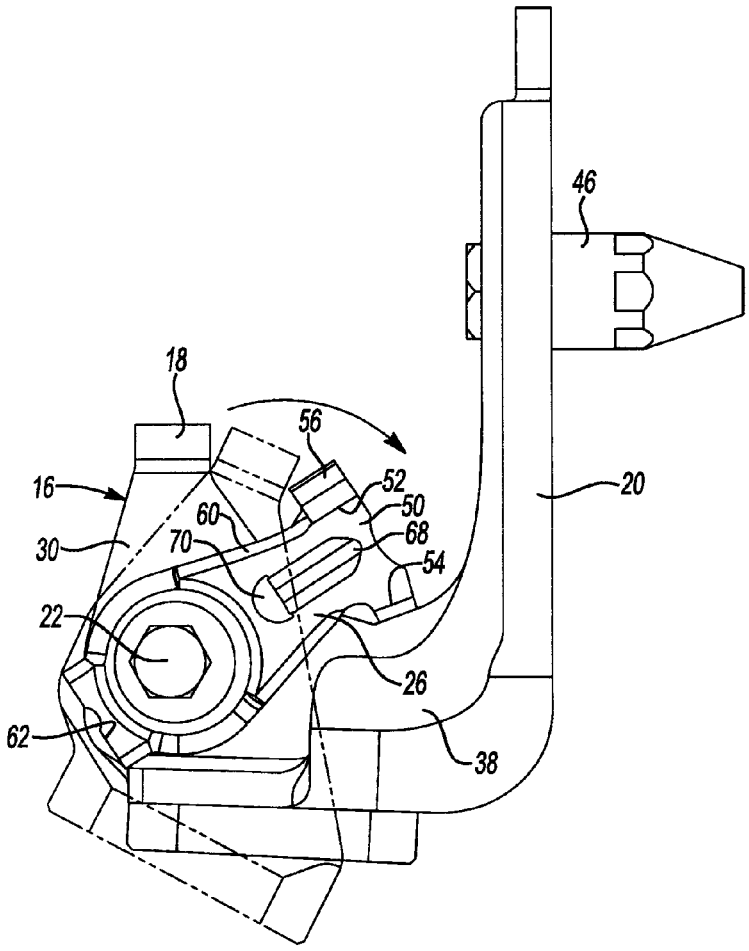
FIG. 4 is a bottom plan view of the hinge and clip in the closed position.
Figure 5:
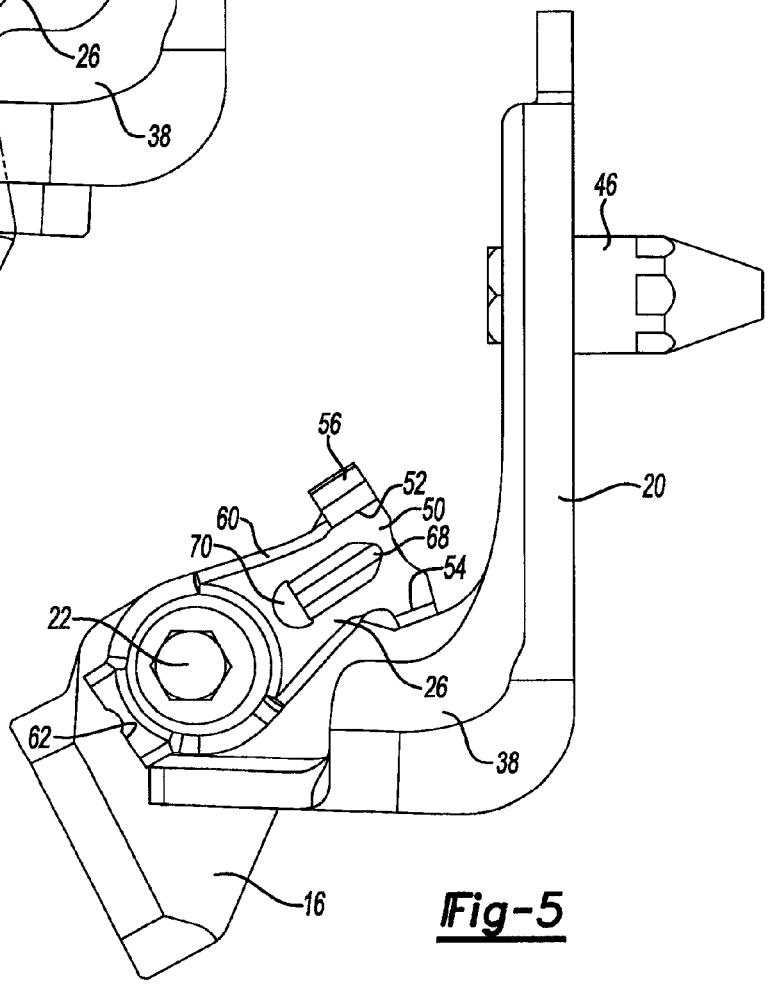
FIG. 5 is a bottom plan view of the hinge and clip in the open position.

Referring to FIGS. 4 and 5, the operation of the clip 26 will be described. In FIG. 4, the door plate 16 is shown in a position with the door closed in solid lines and in an intermediate position in phantom lines. When the door plate 16 is closed, the stop 18 is spaced from the clip 26 and the arm 30 extends generally parallel to the portion of the pillar plate 20 that it fastens to the vehicle. The door plate 16 moves in the direction of the directional arrow shown in FIG. 4 as the door is opened to the position shown in phantom lines. At this point, the door is partially opened, but is not secured against closing during the electro-plating or painting process. The stop 18 is shown just prior to engaging the ramp surface 56 of the first wall 52 of the clip 26.

Referring to FIG. 5, the door plate 16 is shown in its fully open position corresponding to when the door 12 (shown in FIG. 1) is fully opened and ready for electro-coating and painting. In this position, the stop 18 (not shown in FIG. 5) is received in the receiver 50 between the first and second walls 52 and 54 of the clip 26.

Figure 6A:
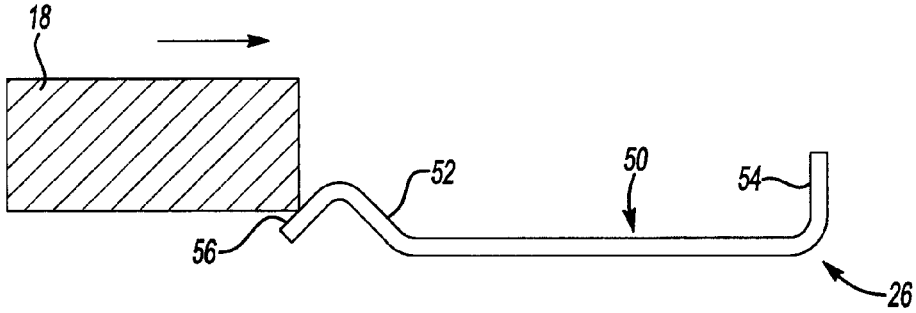
FIG. 6A is a diagrammatic elevation view showing a stop of the door plate engaging a ramp surface of the clip.
Figure 6B:
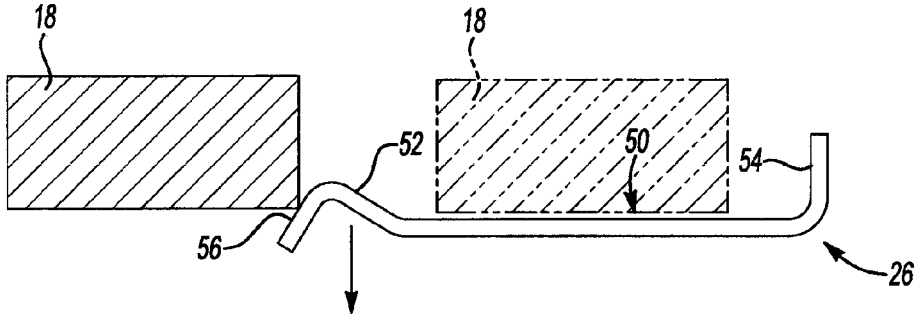
FIG. 6B is a diagrammatic elevation view showing the stop of the door plate depressing a left side of the clip.

Referring to FIGS. 6A and 6B, the operation of the clip 26 will be described in greater detail. The stop 18 initially engages the ramp surface 56 as the door is moved to its opened position. As shown in FIG. 6B, the stop 18 forces the clip down on one side as it passes over the ramp surface 56. The first wall 52 is shifted downwardly with the ramp surface 56 until the stop 18 can pass over the top of the first wall 52 and enter the receiver 50, as shown in phantom lines. Once inside the channel 50, the stop is restrained by the first and second walls 52 and 54. The second wall 54 may be of greater height than the first wall and is intended to engage the pillar plate 20, as shown in FIGS. 4 and 5. The second wall 54 prevents the clip from pivoting below the pillar plate 20.

Figure 7A:
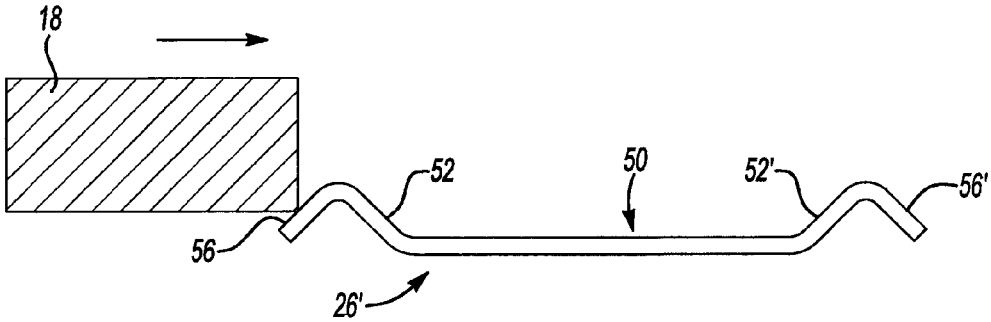
FIG. 7A is a diagrammatic elevation view of a left door stop of the door plate engaging a left side of the clip.
Figure 7B:
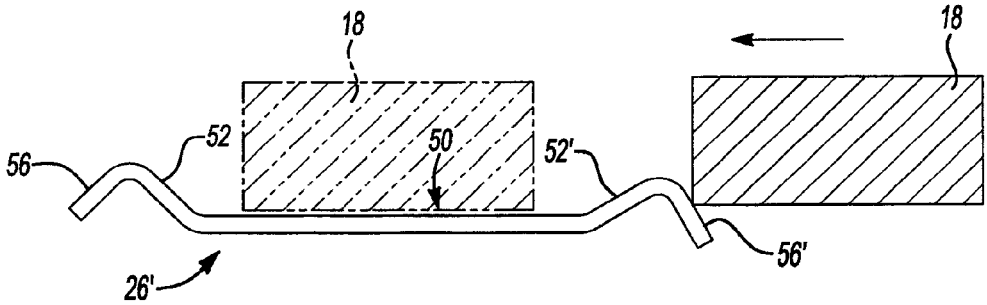
FIG. 7B is a diagrammatic elevation view of a right door stop of the door plate engaging the right side of the clip.

Referring to FIGS. 7A and 7B, an alternative embodiment of a clip 26' is shown. The alternative embodiment of the clip 26 is an interchangeable left/right hand clip that is intended to be used with either the right hand doors or left hand doors of a vehicle. As shown in FIG. 7A, the stop 18 is shown engaging the door plate on a left door. The stop 18 engages a left side of the clip 26 at the ramp surface 56 as it is moved in a manner similar to that described with reference to FIG. 6A above and to the receiver 50. The clip shown in FIGS. 7A and 7B also includes a wall 52' instead of the second wall 54. The wall 52' includes a ramp surface 56' that is generally a mirror image of the first wall 52 and ramp surface 56. As shown in FIG. 7B, the stop 18 is shown engaging the ramp surface 56'. As movement of the stop 18 continues toward the receiver 50, the wall 52' is shifted downwardly to allow the stop to enter the receiver 50.

While the best mode for carrying out the invention has been described in detail, those familiar with the art to which this invention relates will recognize various alternative designs and embodiments for practicing the invention as defined by the following claims.

What is claimed:

1. A hinge for a door of a vehicle, comprising:

a door plate connected to the door that has a stop that extends in an axial direction;

a pillar plate connected to the vehicle;

a pivot pin extending in the axial direction and connecting the plates;

a clip defines an opening that receives the pivot pin and a receiver and a lip that extends at least partially about the clip, the clip flexes axially as the door is opened allowing the receiver to engage the stop.

2. The hinge of claim 1 wherein the receiver is formed on the clip as a channel having two spaced walls that engage opposite sides of the stop.

3. The hinge of claim 1 wherein at least one side of the receiver has a ramp surface that causes the clip to shift axially in a first direction as the door is opened and that has an axially extending wall that catches the stop by shifting the axially clip in a second direction that is opposite to the first direction when the stop is disposed in the receiver to resist closing the door.

4. The hinge of claim 1 wherein the clip defines at least one gap in the lip through which fluid is drained from the clip that is deposited within the lip when the hinge is dipped in a electro-coating bath.

5. A hinge for a door of a vehicle, comprising:

a door plate connected to the door that has a stop that extends in an axial direction;

a pillar plate connected to the vehicle;

a pivot pin extending in the axial direction and connecting the plates;

a clip defines an opening that receives the pivot pin and a receiver, the clip flexes axially as the door is opened allowing the receiver to engage the stop, wherein the clip has an arm that extends radially outwardly from the opening defined in the clip that receives the pivot pin, and further comprising a stiffening rib formed on the arm that extends radially outwardly from the opening that receives the pivot pin.

6. The hinge of claim 5 wherein the arm defines a drain hole through which fluid is drained from the stiffening rib that is deposited in the stiffening rib when the hinge is dipped in a electro-coating bath.

7. A hinge for a door of a vehicle, comprising:

a door plate connected to the door that has a stop that extends in an axial direction;

a pillar plate connected to the vehicle;

a pivot pin extending in the axial direction and connecting the plates;

a clip defines an opening that receives the pivot pin and a receiver, the clip flexes axially as the door is opened allowing the receiver to engage the stop, wherein at least one side of the clip has a ramp surface that causes the clip to shift axially in a first direction as the door is opened and that has a first axially extending wall adjacent the ramp surface and a second axially extending wall, wherein the stop is captured between the first and second walls when the stop is disposed in the receiver to resist closing the door, and wherein the second wall extends to a greater axial extent than the first wall to locate the clip relative to the pillar plate.

* * * * *